United States Patent [19]

Goldfarb et al.

[11] 4,319,424

[45] Mar. 16, 1982

[54] PLAY HOUSE APPARATUS

[75] Inventors: Adolph E. Goldfarb, 4614 Monarca Dr., Tarzana, Calif. 91356; Nancy D. Middleton, Van Nuys, Calif.

[73] Assignee: Adolph E. Goldfarb, Tarzana, Calif.

[21] Appl. No.: 121,643

[22] Filed: Feb. 14, 1980

[51] Int. Cl.[3] ..... A63H 3/00; A63H 3/52

[52] U.S. Cl. ..... 46/12; 46/15; 46/116

[58] Field of Search ..... 46/12, 13, 14, 15, 116, 46/21, 19; 223/106

[56] References Cited

U.S. PATENT DOCUMENTS

| | | | |
|---|---|---|---|
| 1,493,277 | 5/1924 | Pool | 46/12 |
| 2,234,739 | 3/1941 | Murrell | 46/116 X |
| 2,560,155 | 7/1951 | Brunetti | 46/19 |
| 2,872,753 | 2/1959 | Fenton | 46/19 X |
| 3,363,360 | 1/1968 | Ryan | 46/12 |
| 4,030,234 | 6/1977 | Allen | 46/19 X |
| 4,139,967 | 2/1979 | Kuna et al. | 46/12 |
| 4,165,579 | 8/1979 | Chase | 46/13 |

FOREIGN PATENT DOCUMENTS

| | | | |
|---|---|---|---|
| 344966 | 9/1904 | France | 46/21 |

*Primary Examiner*—F. Barry Shay

*Attorney, Agent, or Firm*—Romney, Golant, Martin, Disner & Ashen

[57] ABSTRACT

A doll play set including a doll figure and a doll house. The doll house is open access, having a circular floor and three radially-extending upright walls defining three areas for play within a generally hemispherical outline or outer shape. The doll house is rotatably mounted on a base to afford ready access to all the areas. A receptacle for the doll figure is provided at the upper center of the doll house. There is a playhouse cover of flexible material, conforming to the hemispherical shape of the doll house, and being supported solely by the walls. The cover has a central opening to afford access to the receptacle. The components are proportioned to permit both (1) the doll to be placed in the receptacle up to its waist, with the cover over the doll house giving the appearance of an oversized skirt, and (2) the doll to be placed and played with in the play areas, the doll being shorter than the walls. The illustrated walls have sections pivotally mounted for movement between positions within the doll house outline and positions outwardly of such outline to enlarge the effective play areas. The sections may represent household articles such as furniture or appliances. Further, the sections may represent one article when in one position and a different article when in a different position.

15 Claims, 10 Drawing Figures

FIG. 1
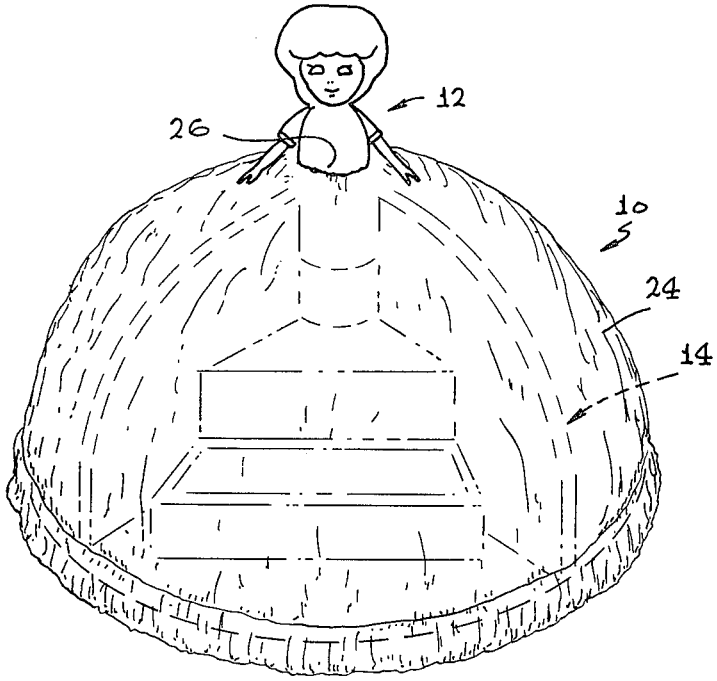
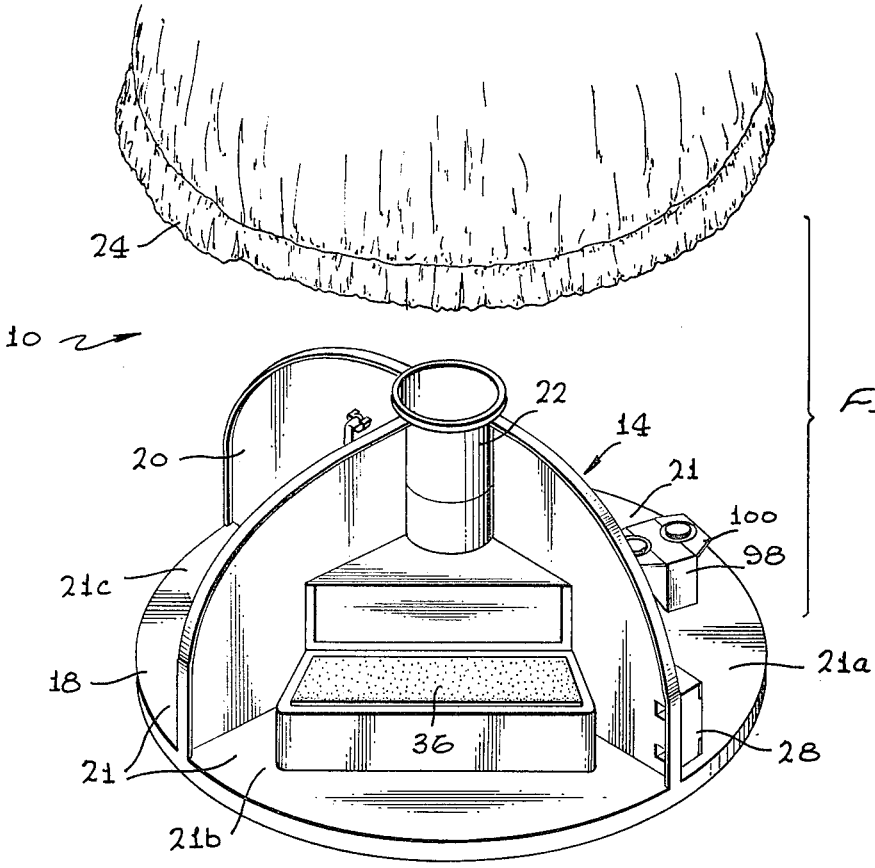
FIG. 2

FIG. 3
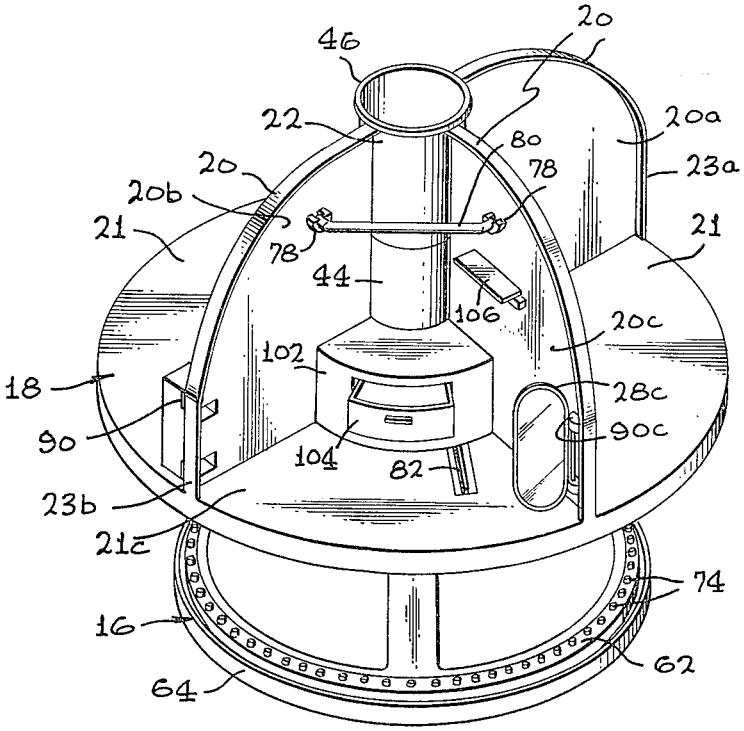
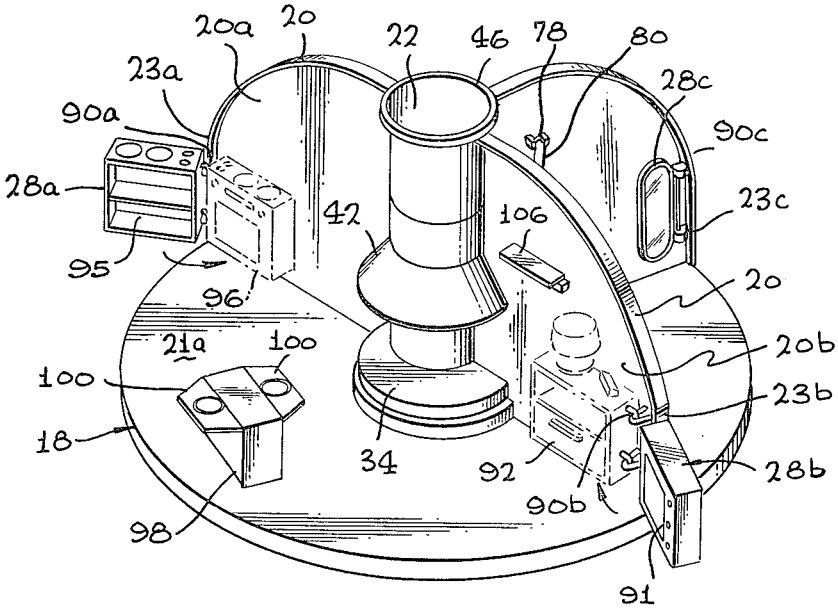
FIG. 4

PLAY HOUSE APPARATUS

There have been many doll houses in the prior art. Many of these were essentially closed in the sense of having limited access such as only through doorways or windows or partially open walls or roofs. They were also normally fixed or stationary in position. Such constructions offered obvious constraints on the areas which would be used conveniently for play. Other doll houses were open in construction to provide better access to the interiors, however they tended to produce an unsightly and messy appearance when they were not in use. When covers as were provided for such open play structures they tended to be unattractive. Further, the size of the cover generally defined and thus limited the size of the play area of the play structure. Such covers were often rigid and occupied a good deal of space when they were not being used.

The doll play set of the present invention contemplates structure which obviates many of the foregoing disadvantages.

For one thing, the walls of the illustrated doll house, which define a plurality of open play areas, are provided with expansion means which may be in the form of attached movable miniature toy appliances, furniture or other household articles. Such movable articles may be moved between positions within the outer shape or outline of the doll house and positions outside that outline to enlarge the play areas. The movable means may represent one article in one position and a different article in the other position. For example, a stove within the confines of the doll house may become a TV set disposed outwardly adjacent to the doll house. When the articles are within the doll house outline, it is reduced to its compact size to accommodate a cover. The doll house is also rotatably mounted to provide the the child ready access to each of the play areas.

In another aspect, the walls of the open doll house provide the only support for the cover, which is flexible and generally conforms to the outline or outer contours of the doll house as defined by the walls. When the cover is not being used it may be readily collapsed to a small size.

In still another aspect, when the cover is in place on the doll house it gives the appearance of an enlarged skirt. The doll house also includes a receptacle for receiving the lower portion of a doll used with the play set. With the doll in the receptacle and exposed from the waist up, and with the cover in place, the cover appears to be an enlarged skirt for that doll. On the other hand, the doll, the doll house and the skirt/cover are so proportioned that when the doll is not in the receptacle and the cover is removed, the doll may be used for play within the doll house. In this connection the height of the doll is less than the maximum height of the doll house walls. Thus, the structure provides a place (the receptacle) to store the doll when it is not being used. The doll may be seen at all times and provides an attractive display which may be placed on the child's dresser or desk.

It is therefore an object of the present invention to provide an open structure doll house defining one or more play areas and having means for expanding the play area and subsequently contracting the play area.

It is another object to provide such a doll house where the means for expanding and contracting represent miniature toy household articles such as furniture or appliances.

It is another object to provide such a doll house where one household article is represented when a means is expanded and a different article is represented when the means is contracted.

It is a further object to provide a doll house and cover which are proportioned and arranged in relation to a doll useable within the house to support the doll, when the house is not being used, with essentially the upper portion of the doll exposed and the doll house and cover providing the representation for the remainder of the doll. It is a more specific object to provide apparatus as just described wherein the doll is supported so that it is, essentially, exposed from its waist up, and the doll house and cover provide a representation in the form of an enlarged skirt for the portion of the doll from the waist down.

It is a further object to provide an open doll house where the outer contour or outline of the doll house, i.e., the walls, provides the only support for a flexible cover.

It is still another object to provide a rotatable doll house having a plurality of circumferentially arranged play areas that can be moved into the user's ready reach.

IN THE DRAWING

FIG. 1 is a perspective view of a doll play set which embodies a presently preferred form of the invention.

FIG. 2 is an exploded perspective view, partially broken away, showing the open doll house with the cover lifted away to expose one play area.

FIG. 3 is an exploded perspective view of the doll house from another angle to show a second play area, and of a base on which the doll house is rotatively mounted.

FIG. 4 is another perspective view of the doll house showing a third play area.

Figure 5:
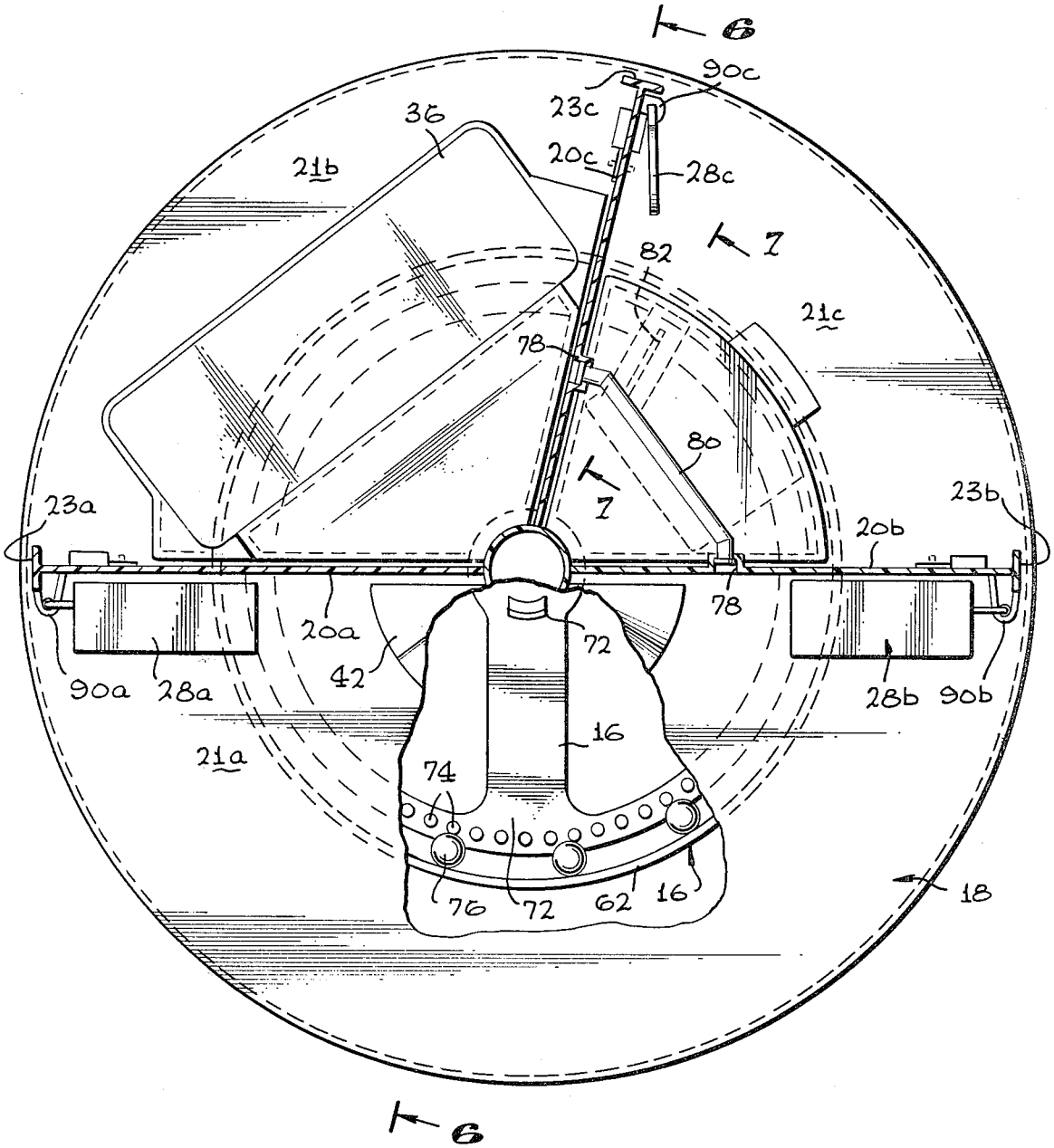
FIG. 5 is an enlarged top plan view of the doll house, with portions broken away.

In general, the illustrated doll play set 10 comprises a doll figure 12, and a doll house 14. The doll house 14 has a generally hemispherical outline or outer shape as defined by a circular floor 18 and three upright arcuate walls 20 supported by the floor. The walls 20 extend radially outwardly so as to create three play areas 21. An upwardly open receptacle 22 for the doll figure 12 is provided at the top of the doll house where the walls converge. The doll house has a matching generally hemispherically shaped cover 24 of flexible material which fits over and generally conforms to the shape of the doll house, and is supported soley by the walls 20. The cover 24 has an opening 26 affording access to the receptacle 22 when the cover is assembled onto the doll house. The components are proportioned so that the doll figure can both (1) reside to its waist in the receptacle when the cover is in place and the cover will appear as an oversized skirt for the doll figure, and (2) be placed in and made to move about the play areas 21 within the doll house, which are at least as high as the doll figure.

The play areas 21 can be enlarged by folding out sections 28 that are pivoted at the outer edges of the walls 20. These sections 28 may simulate miniature furniture appliances or added wall portions. The doll house 14 is also rotatably supported on a base 16 to permit the user to easily move any of the play areas into reach without having to walk around to different sides of the doll house.

Figure 6:
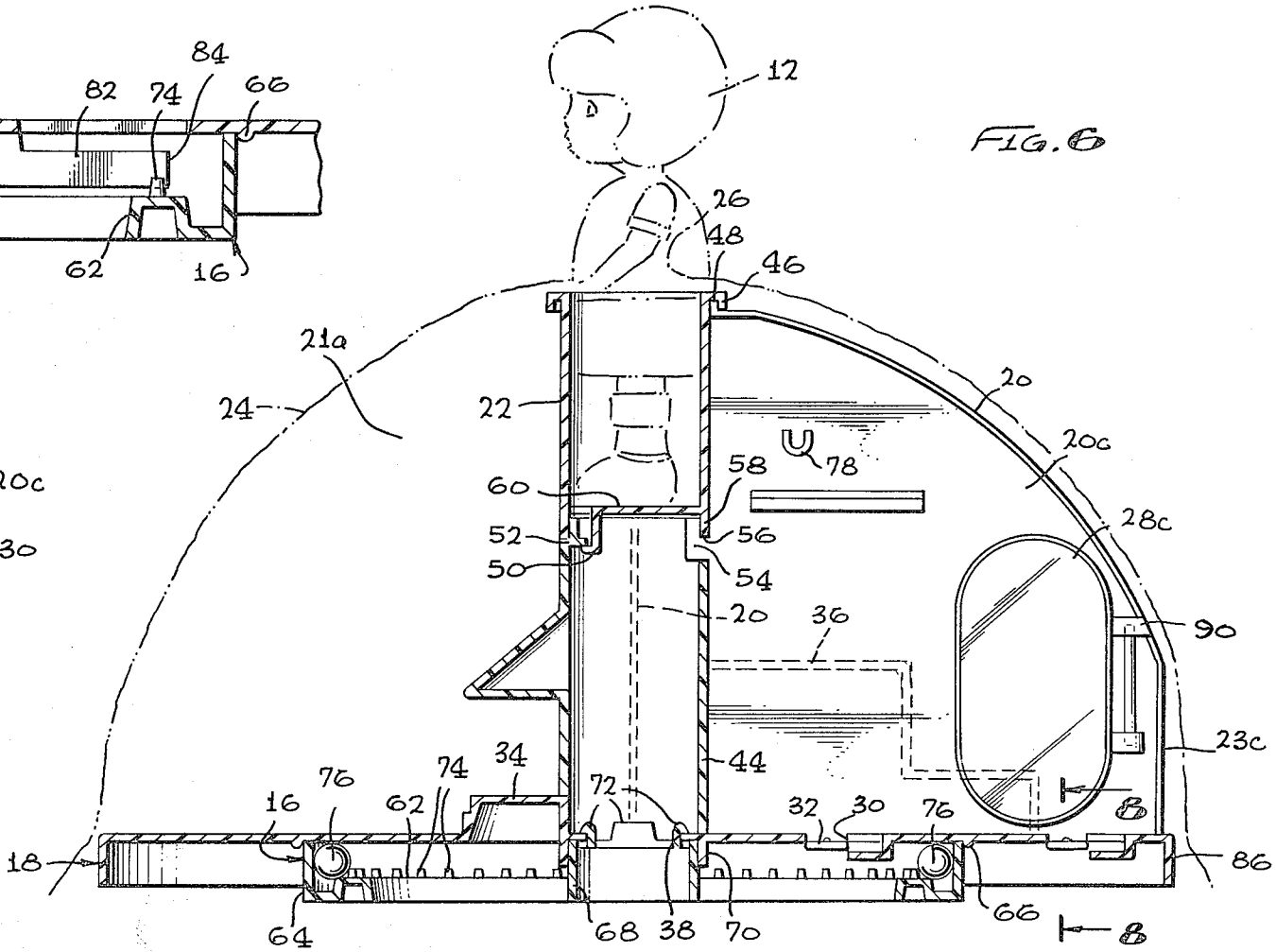
FIG. 6 is a side sectional view taken generally along line 6—6 of FIG. 5.
Figure 8:
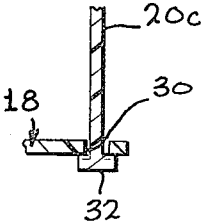
FIG. 8 is the sectional view taken generally along line 8—8 of FIG. 6.
Figures 9, 10:
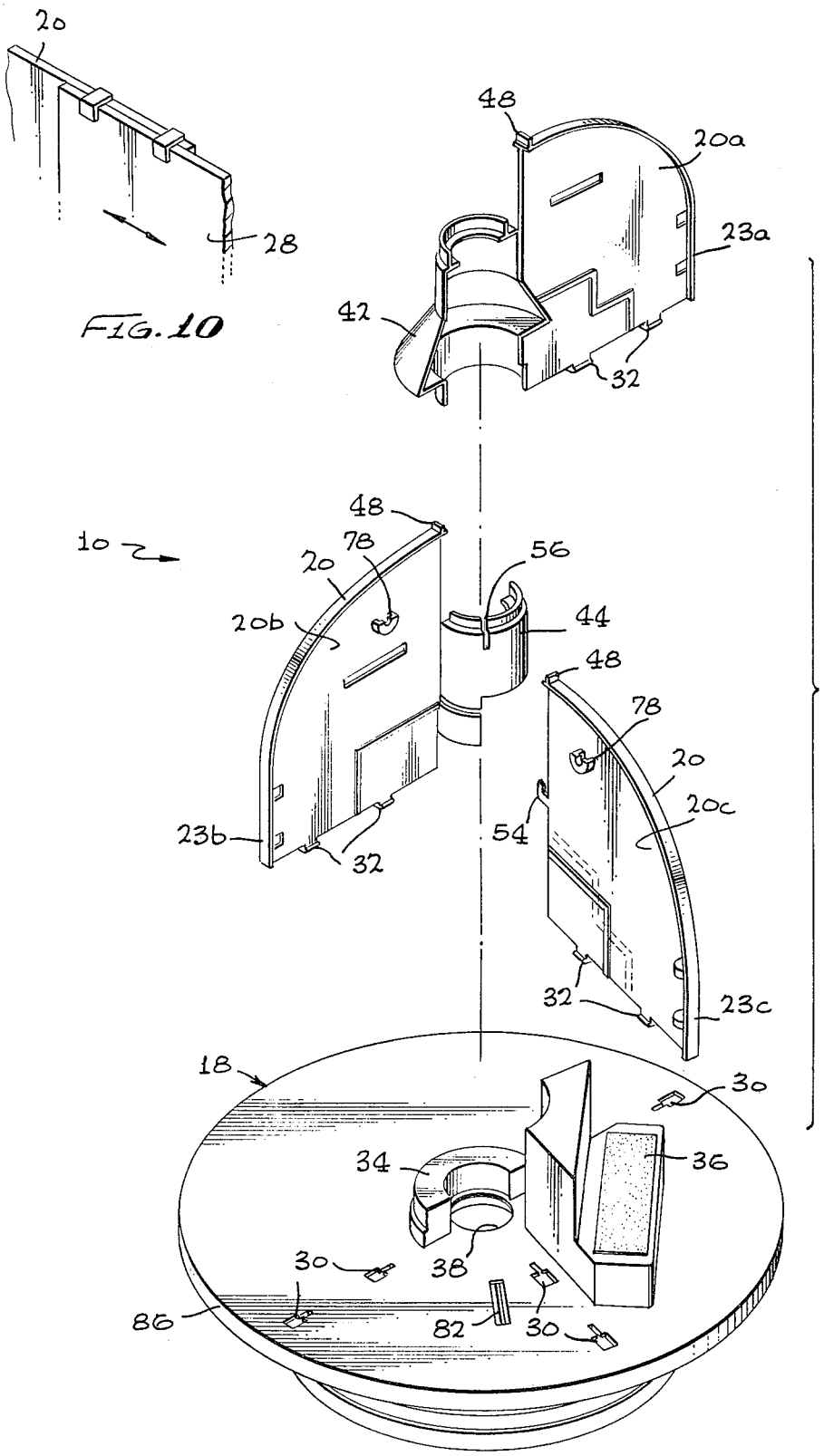
FIG. 9 is an exploded perspective view of the floor and 3 wall sections which make up the doll house.
FIG. 10 is a fragmentary view of a modified wall and associated extension section.

Now to describe the illustrated structure in further detail. The doll figure 12 may be of generally conventional construction, having a body, a pair of arms, a pair of legs and a head. The arms, legs, and head may be movably mounted on the body and/or the arms and legs may be articulated at the knees and elbows; suitable clothing is provided for the doll figure. The proportioning of the doll figure 12 can best be seen from FIGS. 1 and 6. In general, the full height of the doll figure 12 is slightly less than the maximum height of the doll house, as measured from the floor 18 to the highest portions of the walls adjacent to the center of the house. The distance from feet to waist of the doll figure is approximately equal to the depth of the receptacle 22, so that when the doll figure is placed in the receptacle it extends outwardly above the receptacle from its waist up. The doll house 14 is constructed of the floor 18 and the three upright walls 20 shown in exploded relationship in FIG. 9. The doll house may be made of any convenient material, and it is illustrated as comprised of molded plastic parts interconnected together. As shown in FIG. 9, the floor 18 is a generally circular piece having interlock means 30 for interlocking with interlock means 32 on the walls 20. As shown in FIGS. 6, 8 and 9, each wall interlock means 32 is a depending tab having a generally T-shaped cross section and each floor interlock means 30 is a mating opening. The molded floor piece 18 defines a circular center opening 38, a miniature fireplace hearth 34, and a miniature representation of bed 36.

The illustrated walls 20 divide the doll house and the floor into three play areas 21 as shown best in FIG. 5. One area **21*a* is essentially 180° and represents a living room as shown in FIG. 4. A second area 21*b* is somewhat over 90° and represents a bedroom as shown in FIG. 2. A third area 21*c* is somewhat under 90° and represents a closet/dressing room as shown in FIG. 3. One of the walls is also formed with a representation of a Swedish type fireplace 42 of generally tubular section 44. When the walls are assembled together and with the floor, the fireplace 42 aligns with the hearth 34, and a generally central tubular support structure for supporting the receptacle 22 at the upper center of the doll house (as shown in FIG. 6**) is provided.

FIG. 6 shows the tubular receptacle 22 which has an outwardly and then downwardly turned peripheral lip 46 around its upper edge. The lip 46 interlocks with tabs 48 on the walls 20. At its lower end the receptacle 22 has a locking tab 50 (FIG. 6) that interconnects with a lip 52 around the inside of the fireplace 42. Another wall 20 has a hook-like finger 54 that extends through a slot 56 in tubular section 44 to interlock with the lower end 58 of the receptacle. The receptacle has a transverse floor 60 spaced slightly above its lower end to support the doll figure 12.

The assembled doll house 14 comprising the floor, three walls and receptacle is rotatably mounted on the base 16 as best shown in FIG. 6. The base 16 may also be a molded plastic piece. The base 16 is generally circular having a bottom wall 62 and an upwardly extended peripheral wall or lip 64. On the underside of the floor 18 spaced inwardly from its outer edge is a downwardly extending circular rib 66 which circles the upper edge of the base lip 64. At the center of the base wall 62 there is an upwardly extending central tubular hub 68 which is rotatably received in a mating tubular section 70 which depends from the underside of the floor 18 around the center hole 38. The base and house are retained together by four upwardly extending integrally formed tabs 72 on the hub 68. The tabs 72 each have an outwardly turned locking portion along its upper outer edge. When the tabs 72 are pushed upwardly through the central opening 38 in the floor they provide a snap-fit interconnection between the base and the doll house. As shown best in FIG. 3, there is a circularly arranged row of spaced-apart upwardly-extending projections 74 on top of the base wall 62. The rows of projections 74 are spaced from the base lip 64 to accommodate roller bearing means which may take the form of a plurality of marbles 76.

Figure 7:
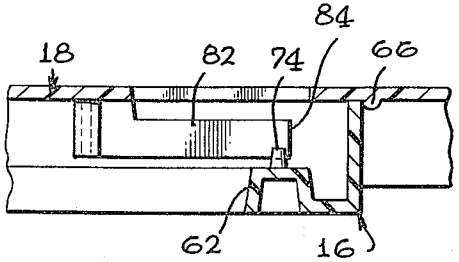
FIG. 7 is a sectional view taken generally along line 7—7 of FIG. 5.

Thus, the doll house 14 is easily and readily rotated on the base 16 to bring any desired play area to a reachable and accessible position adjacent to the child/user. The structure is also designed and arranged to facilitate the rotation of the doll house and maintaining it in selected rotated positions. More particularly, as shown best in FIGS. 3 and 7, an elongated stop finger 82 is secured to the underside of the floor 18 and extends generally radially outwardly. The finger 82 is secured at its radially inward end, while its radially outward end 82 is free and unattached. The finger end 84 is generally disposed to have its outermost edge intersect the row of projections 74 on the base as shown best in FIG. 7. The finger end 84 will thus tend to reside between a pair of spaced apart projections 74 to thereby maintain the doll house in a selected rotational position relative to the base. Rotational movement imparted to the doll house will tend to cause the finger 82 to flex to thereby permit end 84 to slide past successive projections 74 in the row until a new rotational position for the doll house is established.

As shown in FIG. 6, the floor 18 of the doll house is provided with a downwardly extending peripheral lip or wall 86.

As noted above, the walls 20 are provided with extendable sections or portions 28, that each can be moved between a collapsed position within the outline of the doll house and an expanded position extending substantially outside the outline of the doll house to enlarge the play areas. Referring particularly to FIGS. 4 and 5, one of the sections 28 in the form of a miniature simulated household article **28*b* is pivotally mounted about a vertical axis at the outer edge 23*b* of wall 20*b*. The article 28*b* which may be made of any suitable material such as molded plastic is shown in solid line in FIG. 4 in its extended position representing on its forwardly facing surface a TV set 91. The article 28*b* is pivotally mounted at its inward end by suitable hinge means 90*b*. The article 28*b* may be pivoted inwardly as shown by the arrow in FIG. 4 to the broken line position where it is essentially against the wall 20*b*. When in this inward or collasped position, the article 28*b* presents its opposite surface 92 which instead of representing a TV set represents a set of drawers and shelves. Thus, when the article 28*b*** is pivoted to the inward or collasped position it represents one household object and when it is pivoted to its outward or extended position it represents a totally different household object.

Similarly, at the outer edge 23*a* of wall 20*a* there is pivotally mounted on a hinge means 90*a* another miniature household article 28*a* which represents a stove 95 in its extended position (as shown in solid line) and a hi-fi cabinet 96 in its collapsed position against the wall 20*a* (as shown in broken line).

Similarly the wall 20*c* may have pivotally mounted adjacent its outer edge 23*c* on hinge means 90*c* a miniature representation of a full length mirror 28*c*. Suitable releasable attachment means may be provided for holding the movable extention sections 28 in place when they are in the contracted position as shown in FIG. 5 and/or the extended position as shown in FIG. 4.

It will be understood that the enlargement of the play areas by having sections movable from collapsed positions to extended positions may be accomplished in various other ways. For example, instead of being pivoted, the sections may be mounted for sliding movement generally along the plane of the associated wall to extend outwardly beyond the outer edge of the wall as shown for example in FIG. 10. Further, these extentions need not constitute miniature articles of furniture or the like but may be wall sections.

The doll house may include other play articles, as for example a small simulated table 98 having pivoted leaves 100. Similarly a built-in dresser section 102 may be provided in the dressing room/closet area 21*c* and provided with a small drawer 104 which opens and closes. Various other simulated household article may be provided as for example small 3 dimensional shelves 106.

As shown best in FIG. 5, the closet area 21*c* includes a pair of molded receptacles 78 on opposite walls and there is a transversely extending miniature clothes bar 80 which is supported between the walls by the receptacles. The bar 80 is enlarged at either end and the end portions of the bar offset angularly from the remainder of the bar to directions generally perpendicular to the planes of the opposite walls 20*b*, 20*c*.

FIG. 6 shows the general outline of the doll house as it being essentially hemispherical. More specifically each wall 20 has a generally arcuate outer edge with a short straight section at its upper end and a generally longer vertical upright section at its lower end. As also shown in FIG. 6, the flexible skirt cover 24, which may be made of cloth or other similar material suitable for collapsing or folding when not in use, generally conforms to and is supported by the upright walls. Thus, as noted above, no additional support is used with or needed by the skirt/cover.

Various modifications may be made in the illustrated structure without departing from the spirit and scope of the claimed invention. For example, the doll figure may be supported in various ways other than by the use of a receptacle such as disclosed.

What is claimed is:

1. A doll play set comprising:

(a) a separate, essentially full length doll figure having a full height, said figure having a lower leg portion and an upper body portion including at least a head, (b) a separate, open, generally dome-shaped doll house which comprises:

(1) a generally horizontal floor having an outer edge;

(2) at least one upstanding wall mounted on and extending generally transversely of the floor to define at least two separate play areas, said wall having an upper edge that increases in height as it progresses in a direction away from the outer edge of the floor, the wall having a maximum height greater than the full height of the doll figure whereby the doll figure can be used for play within said doll house; and (3) means on the wall for supporting the doll figure with said upper portion of the doll figure extending above the doll house and said lower leg portion disposed within the outline of said doll house; and (c) a separate removable cover having generally the shape defined by the wall of said doll house and having an opening for the doll figure to extend upwardly through when said cover is assembled on said doll house and said doll figure is supported by said support means on said doll house, said cover simulating the appearance of an enlarged skirt for said doll figure.

2. A doll play set as set forth in claim 1 wherein said upstanding wall extends generally radially outwardly from the center of said floor and is higher at the center and progressively lower toward the outside.

3. A doll play set as set forth in claim 2 wherein there are a plurality of said walls and they define at least three play areas between them.

4. A doll play set as set forth in claim 3 wherein said walls are unevenly spaced to provide play areas of different sizes.

5. A doll play set as set forth in claim 3 further comprising means rotatably supporting said floor for rotation about a vertical axis through its center.

6. A doll play set as set forth in claim 1 wherein the outline of said doll house is generally hemispherical.

7. A doll play set as set forth in claim 1 wherein the outline of said doll house is generally conical.

8. A doll play set as set forth in claim 3 wherein there are at least three of said walls, and said cover is flexible and when on the doll house is supported solely by the walls of the doll house.

9. A doll play set as set forth in claim 1 further including at least one pivoted foldout element hingedly mounted adjacent to the outside edge of one of said upright walls and pivotal between a position within the outline of said doll house and a position extending substantially outside of said outline, said element providing a miniature representation of an object other than the wall or a portion thereof, said element representing one object when in collapsed position and a different object when in its extended position.

10. A doll play set as set forth in claim 9 wherein said objects are miniature household articles.

11. A doll play set as set forth in claim 10 wherein said articles are furniture and/or major appliances.

12. A doll play set as called for in claim 1 wherein said upright wall includes a movable portion which may be selectively moved from a collapsed position within the outline of said doll house to an expanded position substantially outside the outline of the doll house to thereby substantially increase the play area when in the expanded position.

13. A doll play set as set forth in claim 12 wherein said movable portion is mounted on said wall for linear movement generally parallel to said wall.

14. An open construction play house with movable means for enlarging the effective play area, comprising a generally horizontal floor portion, at least one generally vertical wall portion mounted on said floor portion and having an outer edge, an initial play area being defined by said floor portion and said wall portion, a cover for being removably disposed over said wall portion immediately outwardly of said outer edge, and movable means pivotally mounted at said outer edge for selective pivotal movement about a generally vertical axis between a first position within said initial play area and a second position extending outwardly substantially beyond said outer edge and outside of said initial play area to create an enlarged play area when the cover is removed, said movable means providing a miniature representation of an object other than the wall portion or a part thereof, said movable means representing one object when in said first position and a different object when in said second position, said vertical wall portion extending generally radially outwardly from the center of said floor portion and being higher at the center and progressively lower toward the outside, there being at least three of said vertical wall portions that define at least three play areas between them, said cover being flexible and, when on the house, being supported solely by the vertical wall portions of the house.

15. A doll play set as set forth in claim 1 wherein said doll figure support means comprises a receptacle proportioned to receive approximately the lower leg portion of said doll figure.

* * * * *